US005101876A

United States Patent [19]

Zak

[11] Patent Number: 5,101,876

[45] Date of Patent: Apr. 7, 1992

[54] LOUVER COVERING SYSTEM

[76] Inventor: Helga M. Zak, 1119 N. Chestnut Ave., Arlington Heights, Ill. 60004

[21] Appl. No.: 647,736

[22] Filed: Jan. 30, 1991

[51] Int. Cl.[5] ..... E06B 9/00

[52] U.S. Cl. ..... 160/236; 160/178.1

[58] Field of Search ..... 160/236, 168.1, 166.1, 160/178.1, 900

[56] References Cited

U.S. PATENT DOCUMENTS

| | | | |
|---|---|---|---|
| 2,074,482 | 3/1937 | Martens . | |
| 2,142,629 | 1/1939 | Clark . | |
| 2,207,420 | 7/1940 | Thomas . | |
| 2,803,297 | 8/1957 | Wenke . | |
| 2,828,816 | 4/1958 | Nestor . | |
| 2,914,122 | 11/1959 | Pinto | 160/166.1 X |
| 2,994,370 | 8/1961 | Pinto | 160/236 X |
| 3,031,045 | 4/1962 | Hallock . | |
| 3,298,425 | 1/1967 | Cayton et al. | 160/178.1 X |
| 4,049,038 | 9/1977 | Hyman et al. . | |
| 4,128,914 | 12/1978 | de Wit | 160/178.1 X |
| 4,195,680 | 4/1980 | Hyman et al. . | |
| 4,309,472 | 1/1982 | Götting et al. . | |
| 4,519,435 | 5/1985 | Stier . | |
| 4,597,429 | 7/1986 | Driessen | 160/236 |
| 4,628,980 | 12/1986 | Le Houillier . | |
| 4,696,336 | 9/1987 | Dixon | 160/900 X |
| 4,832,572 | 5/1989 | Prucha et al. . | |
| 4,884,615 | 12/1989 | Hsu | 160/236 |
| 4,893,667 | 1/1990 | Dunn | 160/236 |
| 4,911,220 | 3/1990 | Hiller . | |
| 4,930,562 | 6/1990 | Goodman . | |
| 4,951,729 | 8/1990 | Chi Yu | 160/236 X |
| 4,955,419 | 9/1990 | Morris | 160/178.1 X |

*Primary Examiner*—David M. Purol

*Attorney, Agent, or Firm*—Willian Brinks Olds Hofer Gilson & Lione

[57] ABSTRACT

A cover for vertical louver blinds is disclosed. The louver cover consists of an oblong piece of material which is folded lengthwise into front and back panels of sufficient length and width to cover a vertical louver, for example. The panels are joined along their two outer edges to form a sleeve to substantially enclose the vertical louver. The junction along the outer side edge has an unjoined zone near the bottom edge through which a louver or weight is inserted and chains can pass. The top edges of the front and back panels have joined portions and an unjoined portion. The joined top portions support the cover on the louver and the unjoined top portion permits passage of the means for hanging the vertical louver. The bottom edges of the front and back panels are also joined. This cover alone can also serve as a louver by inserting a slotted cross-bar in the top of the cover and a weight in the bottom of the cover.

11 Claims, 3 Drawing Sheets

LOUVER COVERING SYSTEM

FIELD OF THE INVENTION

This invention is directed to window treatments, and more particularly, to a louver blind covering system which allows decorative changes to the louvers in the system without purchase of new louvers.

BACKGROUND OF THE INVENTION

Vertical blinds have been used extensively for decorative coverings of windows, doors and the like. It has long been a practice to coordinate the color of louvers in such systems with the decor of the room. However, it is impractical to maintain an inventory of louvers in the tremendous number of different colors, shades and patterns used in contemporary styling.

In addition, when it is time to redecorate and coordinate the color of the louvered system to a new color scheme, it is necessary either to replace the louvers themselves or the entire vertical blind system. Adding a colored pattern to a vertical louver system has been difficult and expensive.

One way to attach a colored pattern to louvers is to permanently glue material onto the louvers. Another way to attach a colored pattern to louvers is disclosed in U.S. Pat. No. 4,628,980, to LeHouillier. There, each louver has flanges along its side edges into which strips of wallpaper or other stiff material are inserted. The strips must be cut precisely to be secured by the flanges. Even so, with changes in humidity or temperature, inserted strips may swell and buckle, or may shrink and slip out of the flanges.

Covers for vertical blind louvers also have been proposed. U.S. Pat. No. 4,911,220, to Hiller shows a vertical blind cover which is closed at the bottom, and secured at the top with extensions and snaps. However, adding narrow extension tabs and snaps to a simple tube increases manufacturing difficulty and price. In addition, Hiller makes no provision for a popular feature of vertical blinds: the attachment of chains and weights to the vertical blinds to keep them in place in wind. Such chains usually are attached to one side of a louver and connect each louver to neighboring louvers. The connections are one to two inches from the bottom edges of the vertical blinds. The chain usually is out of sight, being strung along the surface of the vertical blind system facing the window or door.

Some manufacturers offer blinds with two chains, which are attached to both lower side edges of the louvers. In that event, there is a chain running along the lower edge of the blinds on the window/door surface of the system and another chain on the surface visible from inside the room.

Cloth louvers also have been proposed. U.S. Pat. No. 4,309,472 to Gotting et al. teaches the manufacture of louvers from flame-retardant-treated polyester that has been permanently stiffened by plastification. Once treated, the special material is cut into slats. This material has the advantage over plastic or wood louvers of being transparent to light.

What is needed is a louver cover which is simple in design, eliminating expensive extensions and snaps, but adapted to accommodate the use of chains and/or weights.

SUMMARY OF THE INVENTION

In accordance with the teachings of the present invention, a decorative cover is provided which covers a conventional vertical blind louver and accommodates the attachment of chains and weights. The covering is constructed from one oblong piece of material which is folded in half lengthwise to form a front and a back panel. These panels are joined at the side, top and bottom edges, except for (1) a small opening in the top edge to accommodate a means for hanging the louver and (2) an opening in the side edge near the bottom of the cover through which the louver is inserted and side chain and weights are attached.

The cover is sufficiently long and wide to cover, for example, a vertical louver. The front and back panels are joined along their free sides to form a channel or sleeve into which the vertical louver slides. The sides are not entirely joined; there is an unjoined zone near the bottom edge. Through the opening formed by the unjoined zone, the louver or weight is inserted and the chain is attached.

The front and back panels of the cover are also joined at their top edges, except for a short portion through which the means for hanging the louver passes. The cover hangs on the louver by the joined top edges or shoulders. The bottom edges of the front and back panels are also joined.

In another embodiment, the louver cover can be used without the louver, letting light pass through unimpeded by the plastic or wooden louver. A cross-bar is inserted into the top of the louver cover to suspend the louver cover from the means for hanging the louver. Preferably, the louver cover has a weight in the bottom of the cover for improved appearance and attachment of the chain. Although any weight fabric or paper may be used, the preferred material used for this louver is a material which admits a high degree of light. Examples of such material include but are not limited to lace, sheer woven cotton and sheer woven nylon.

A decorative covering system for vertical louvers is accordingly provided. The system is particularly intended for use with vertical louvers, which are suspended from a horizontal apparatus or valance by means for hanging individual louvers. The louver cover is easy and inexpensive to manufacture because it has no extensions or snaps. A further advantage is that this cover accommodates attachment of chains.

The inventive louver cover also has the advantage of being easy to install. One detaches the louver from the valance. Next, one folds the bottom edge of the cover away from the side opening and slides the louver into the opening, being careful to line up the lower side opening with the chain attachment on the lower side edge of the louver. When the louver is fully inserted, the bottom cover edge is unfolded over the bottom edge of the louver. Then, the louver is hung and the chain attached at the lower side edge.

In another embodiment, the louver system also includes a cover for the valance.

In one embodiment, the louver cover itself serves as a louver when a cross-bar is inserted in the top end of the cover and is slotted to accept the means for hanging the louver cover. Preferably, a weight is placed in the bottom end of the louver cover for improved stability and appearance. The chain is attached to the weight.

The foregoing objectives, features and other advantages of the invention will be further understood upon consideration of the following detailed description of an embodiment of the invention, taken in conjunction with the accompanying drawings, wherein:

DETAILED DESCRIPTION OF THE PREFERRED EMBODIMENTS

Figure 1:
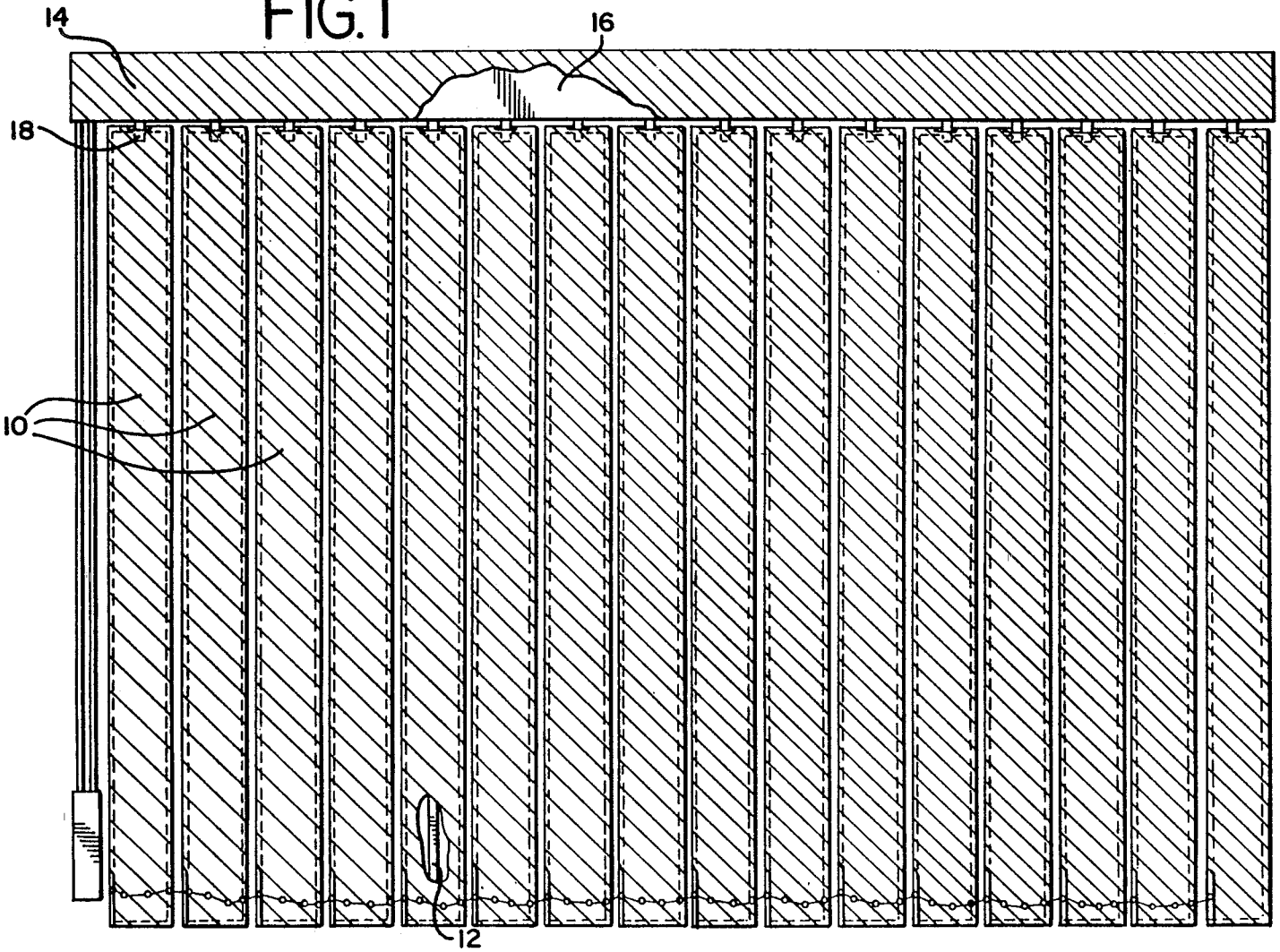
FIG. 1 is a front elevational view of a louver covering system made in accordance with the teachings of the present invention and illustrating the use of the inventive louver covers and a cover for the valance.

FIG. 1 illustrates the louver covering system, including the covers 10 for individual vertical louvers 12, and a cover 14 for the horizontal support or valance 16. The louvers 12 are of a conventional design, as is the valance 16. Conventional louver support systems commonly include a wide, flat, hooking member 18 which cooperates with a slot in the top of louver 12 to both hang the vertical louver 12 and control its orientation about a vertical axis.

Figure 2:
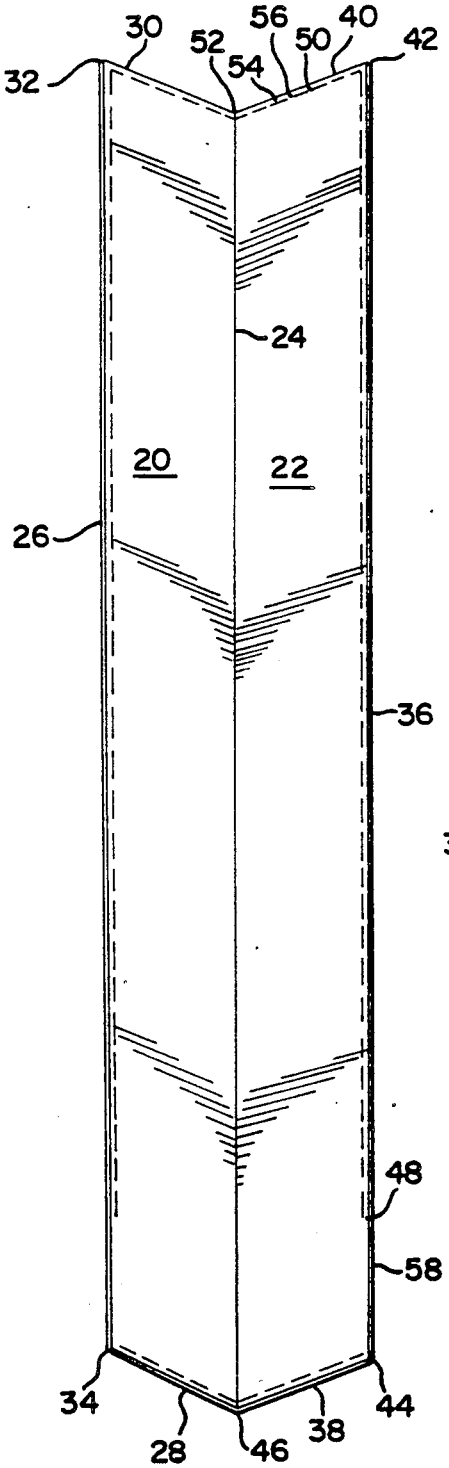
FIG. 2 is an enlarged front elevational view of the vertical louver cover shown in FIG. 1.

Turning to the details of the louver cover 10, the unassembled cover shown in FIG. 2 consists of one piece of material which is folded longitudinally into a front panel 20 and a back panel 22. The louver cover 10 can consist of any conventional patterned or colored material.

The louver cover 10 is preferably constructed of a flexible fabric. The flexible fabric can be any one of many fabrics commonly used in decorating. Typically, such fabric would include, but is not limited to, synthetic polymer textiles, cotton, silk and wool. More preferred are synthetic polymer materials such as nylon, polyester and the like, because they are easy to maintain. Most preferred are patterned textiles which match other materials used to decorate the room in which the louver covers are installed, as for example, matching upholstered couches, chairs, bedspreads, pillows, bed sheets and the like.

Each panel 20, 22 has a folded edge, an outer side edge, a bottom edge, a top edge and two outside corners. Front panel 20 extends from folded edge 24 to outer side edge 26 and from bottom edge 28 to top edge 30. Panel 20 has two outside corners 32, 34. Back panel 22 extends from folded edge 24 to outer side edge 36 and from bottom edge 38 to top edge 40. Panel 22 has two outside corners 42, 44.

To assemble the louver cover, the material is folded on fold line 24, resulting in the outer side edges 26 and 36 overlapping. Then the outer side edges, top and bottom are joined in the following manner. First, the bottom edge is joined, beginning at the lower end 46 of fold line 24 and ending at overlapping corners 34 and 44. Then, starting at point 48, the outer side edges 26 and 36 are joined up to and including corners 32, 42. Preferably, point 48 is approximately four inches up the side from corner 44.

The top edges 30, 40 of panels 20, 22 are joined in two steps. First, the top edges 30, 40 are joined between overlapping corners 32, 42 and point 50. Then, the top edges 30, 40 are joined between point 52, which is the top end of fold line 24, and point 54. The joined areas on top edges 30, 40 form shoulders which support the cover on the louver. Opening 56 in the top of cover 10 accommodates hooking member 18, and opening 58 in the lower outer side edges 26, 36 is used to insert the louver 12 and to attach a chain.

The panels 20, 22 can be joined by any conventional means, such as sewing, gluing and applying heat to heat-fusible materials. If the edges are sewn together, the material is folded together, so that the sides visible in use face each other. Then, the edges are sewn as described above and the entire cover is turned right side out for use.

In another embodiment, bottom edges 28, 38 need not be joined. Corners 34 and 44 are nevertheless joined to give the best appearance.

In another embodiment, there is a slit in the folded edge 24 near the bottom edges 28, 38 of the cover 10 to accommodate a second chain attachment to the louver. Preferably, the slit is approximately two to four inches from the bottom edges 28, 38 of the cover 10.

Alternatively, the front and back panels 20, 22 are formed from separate pieces of material, either of the same or different patterns. In that case, panels 20, 22 are first joined along one entire edge, the equivalent of folded edge 24. Then the cover 10 is assembled as described above.

Preferably, the openings 56, 58 are finished by means known in the art to give a good appearance. Material along openings 56, 58 is turned under so as to be out of sight.

Figure 3:
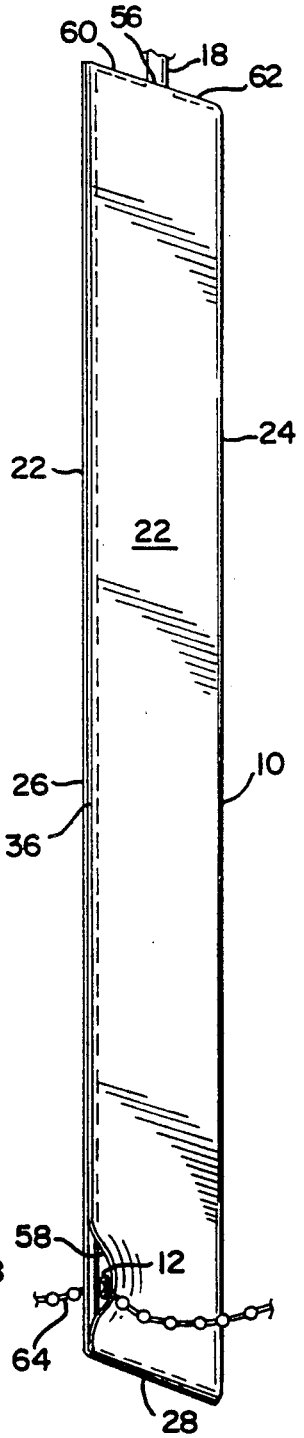
FIG. 3 is an enlarged front elevational view of an assembled louver cover of FIG. 1 installed on a louver and indicating placement of the chains and means for hanging the louver.

The louver cover is shown assembled in FIG. 3. Joined portions 60 and 62 of the top edges are shown on either side of the hooking member 18 which hooks the top of the louver 12 through the opening. A portion of chain 64 is shown entering side opening 58, attaching to the side of the louver 12 and exiting through side opening 58 to connect to an adjacent louver (not shown).

Figure 4:
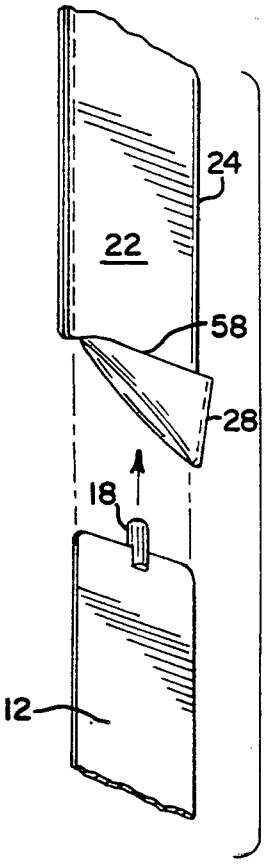
FIG. 4 is an enlarged front elevational view of the bottom edge of the louver cover folded back for insertion of the louver.
Figure 5:
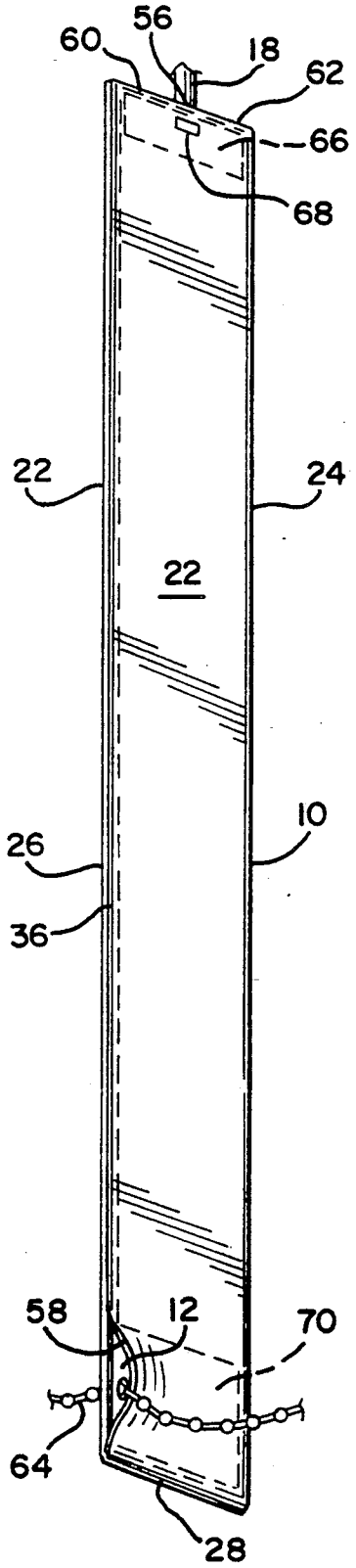
FIG. 5 is an enlarged front elevational view of the cover serving as louver and containing a slotted cross-bar in the top end and a weight in the bottom end.

The louver 12 is shown being inserted into the louver cover 10 in FIG. 4. First, the bottom edge 28 of the louver cover 10 is drawn back over the folded edge 24 to make a temporary opening in the bottom of the louver cover 10. Then the louver 12 is inserted, hooking member 18 first. The louver 12 is inserted so that the louver's side hole for chain attachment is at opening 58. Then bottom edge 28 is unfolded to cover the bottom of louver 12.

In another embodiment, the louver cover serves as a light-admitting louver. The louver cover is fabricated as described above. The difference is in the installation. Instead of inserting a vertical louver, the user inserts a short slotted cross-bar 66 into the top end of the cover 10 and inserts the hooking member 18 into the slot 68 in the cross-bar 66. Preferably, weight 70 is placed into the bottom end of the cover 10 to give the best appearance.

In another embodiment, shown in FIG. 1, the louver covering system also includes a removable-style valance cover 14 for the valance 16; such covers are known in the art. If the valance has flanges, a louver cover 10 is slid into the valance flanges and trimmed to the right length.

Thus, while the invention has been described in relation to a particular embodiment, those having skill in the art will recognize modifications of materials, structure and the like which will still fall within the scope of the present invention.

I claim:

1. A removable cover adapted for installing over vertical louver blinds, each louver blind having a top, lateral sides, a bottom, a maximum width and a means for hanging the louver, said cover comprising:

a front panel and a back panel, each panel having a top edge, a bottom edge, an inner side edge and an outer side edge, the front and back panels having length and width adapted to enclose the louver;

said front and back panels being joined together in facial relationship along their outer sides and their inner side edges to form a sleeve, said panels having an unjoined zone along at least one of said side edges near said bottom edge which unjoined zone has a length adapted to exceed the louver's maximum width sufficiently to allow the bottom edge to be folded to the side to permit the louver to pass therethrough;

said panel top edges having joined portions and an unjoined portion, said joined portions being formed by joining said top panel edges of said front and back panels, said joined portions forming shoulders for hanging said cover on the louver, said unjoined portion having sufficient width to permit passage of the hanging means therethrough; and said bottom edge of said front and back panels being joined.

2. The cover of claim 1 wherein said front and back panels are formed from at least two pieces of material consisting of a front and a back panel, said front and back panel each having an inner side edge and an outer side edge, said inner side edge being fully joined, and said outer side edges being joined except for an unjoined portion near said bottom edge, said panels being joined to form said sleeve.

3. The cover of claim 1 wherein a second unjoined zone is formed along said inner side edges.

4. The cover of claim 1 wherein the top edges have a central unjoined portion and two side joined portions, a first joined portion extending from the central unjoined portion to the corner formed by the folded edge and the top edge, and a second joined portion extending from the central unjoined portion to the corner formed by the outer side edge and the top edge.

5. The cover of claim 1 wherein said panels are formed from material selected from the group consisting of cloth, paper, woven and nonwoven cloth, synthetic and natural materials, and combinations thereof.

6. A covering system for a set of vertical louvers, comprising a plurality of vertical louvers and a horizontal apparatus from which the vertical louvers hang and means for hanging each vertical louver from the apparatus, the covering system comprising:

a plurality of removable louver covers, each cover being adapted for installing over a vertical louver, each louver blind having a top, lateral sides, a bottom, a maximum width and a means for hanging the louver, said cover comprising:

an oblong piece of material folded in half lengthwise into a front panel and a back panel, each panel having a top edge, a bottom edge, an inner side edge and an outer side edge, said front and back panels having sufficient length and width to enclose the vertical louver;

said front and back panels being joined together in facial relationship along their outer side edges and inner side edges to form a sleeve, said panels having an unjoined zone along at least one of said side edges near said bottom edge which unjoined zone has a length adapted to exceed the louver's maximum width sufficiently to allow the bottom edge to be folded to the side and to allow the louver to pass therethrough;

said top panel edges having joined portions and an unjoined portion, said joined portions being formed by joining said top panel edges of said front and back panels, said joined portions forming shoulders adapted to hang said cover on the vertical louver, said unjoined portion having a width adapted to permit the passage of the hanging means therethrough; and said bottom edges of said front and back panels being joined.

7. The covering system of claim 6, further comprising a cover for the horizontal apparatus.

8. A covering system for a set of vertical louvers, comprising a plurality of vertical louvers, a horizontal apparatus from which the vertical louvers hang and means for hanging each vertical louver from the apparatus, the covering system comprising:

a plurality of removable louver covers, the louver covers numbering less than or equal to the number of vertical louvers, each cover being adapted for installing over a vertical louver, each louver blind having a top, lateral sides, a bottom, a maximum width and a means for hanging the louver, said cover comprising:

an oblong piece of material, folded in half lengthwise into a front panel and a back panel, each panel having a top edge, a bottom edge, a folded edge and an outer side edge, the front and back panels having sufficient length and width to enclose the vertical louver;

said front and back panels being joined along their outer side edges to form a sleeve, said panels having an unjoined zone along at least one of said side edges near said bottom edge which unjoined zone has a length adapted to exceed the louver's maximum width sufficiently to allow the bottom edge to be folded to the side and to permit the louver to pass therethrough;

said top panel edges having joined portions and an unjoined portion, said joined portions being formed by joining said top panel edges of said front and back panels, said joined portions forming shoulders adapted to hang said cover on said vertical louver, said unjoined portion having sufficient width to permit passage of the hanging means therethrough; and said bottom edge of said front and back panels being joined; and a cover for said horizontal apparatus.

9. A vertical louver blind comprising:

an oblong piece of material, folded in half lengthwise into a front panel and a back panel, each panel having a top edge, a bottom edge, an inner side edge and an outer side edge, the front and back panels having sufficient length and width to form the vertical louver;

said front and back panels being joined along their outer side edges to form a sleeve, said panels having an unjoined zone along at least one of said side edges near said bottom edge;

said top edges having joined portions and an unjoined portion, said joined portions being formed by joining said top edges of said front and back panels, said joined portions forming shoulders adapted to hang the vertical louver, said unjoined portion having a width adapted to permit passage of means for hanging the vertical louver;

said bottom edge of said front and back panels being joined; and a cross bar which is placed in the top of the louver and which has a slot for insertion of the means for hanging said vertical louver.

10. The vertical louver blind of claim 9 further comprising a weight which is placed in the bottom of the vertical louver.

11. The vertical louver of claim 9 wherein said material comprises transparent material selected from the group consisting of lace, sheer nylon, sheer cotton and combinations thereof.

* * * * *